United States Patent [19]

Williams

[11] Patent Number: 4,621,567

[45] Date of Patent: Nov. 11, 1986

[54] BEAM PUMP

[76] Inventor: James F. Williams, 25569 Via Velador, Valencia, Calif. 91355

[21] Appl. No.: 593,643

[22] Filed: Mar. 26, 1984

[51] Int. Cl.[4] ..... F15B 15/24; F01B 9/00; F04B 21/00

[52] U.S. Cl. ..... 92/13.7; 92/168; 92/137; 417/458

[58] Field of Search ..... 417/458, 554; 92/168, 92/170, 130 C, 13.8, 140, 13.7; 74/102, 105; 60/479; 91/377

[56] References Cited

U.S. PATENT DOCUMENTS

| | | | |
|---|---|---|---|
| 476,082 | 5/1892 | Sellon | 74/102 |
| 1,886,022 | 11/1932 | Hutton | 92/13.7 |
| 2,044,044 | 6/1936 | Anthony | 92/13.7 |
| 2,200,012 | 5/1940 | Russell et al. | 92/130 C |
| 2,257,387 | 9/1941 | Kinkade | 92/13.7 |
| 2,648,290 | 8/1953 | Ashton et al. | 92/140 |
| 2,891,480 | 6/1959 | Marcum | 74/105 |
| 3,041,886 | 7/1962 | Atherton | 74/102 |
| 3,097,605 | 7/1963 | Berkley | 92/13.8 |
| 3,220,351 | 11/1965 | Kling | 417/458 |
| 3,330,217 | 7/1967 | Baur et al. | 92/168 |
| 3,382,676 | 5/1968 | Tenniswood | 91/377 |
| 3,545,896 | 12/1970 | Zahradnik | 92/13.8 |
| 3,695,149 | 10/1972 | Eberhart | 92/168 |
| 3,906,845 | 9/1975 | Wegmann | 92/168 |
| 3,931,755 | 1/1976 | Hatridge | 92/168 |
| 3,958,903 | 5/1976 | Capelli | 92/168 |
| 4,024,795 | 5/1977 | Sawyer | 91/377 |
| 4,060,023 | 11/1977 | Vegella | 92/168 |
| 4,411,313 | 10/1983 | Johnson | 417/554 |
| 4,509,723 | 4/1985 | Shimura | 92/13.7 |

*Primary Examiner*—William L. Freeh
*Attorney, Agent, or Firm*—Lyon & Lyon

[57] ABSTRACT

A beam pump for use as a chemical injection pump in conjunction with a walking beam and having a pump shaft which is slidable within a pump body. The shaft is pivotally connected to a lever bar which is drivingly connected to the walking beam. A pivot support bar is semi-rigidly attached to the beam pump body and is pivotally attached to the lever bar. The semi-rigid attachment enables the pivot support bar to move slightly in order to maintain the vertical alignment of the pump shaft with respect to the pump body. Further guidance and sealing is provided by an O-ring seal which is made up of a solid lubricant material, a guide plug and a spring loaded seal ring and back up seal. The pump shaft and pump body surrounding said shaft are coated with a solid lubricant material. Further lubrication of the pump shaft is accomplished by lubrication passages within the pump body. A double acting check valve which has a first ball valve upstream of a metal seat and a second ball valve upstream of an O-ring seat is used to prevent leakage back to the chemical source. An adjustable stroke limiter is provided to limit the amount of chemical injected with each stroke of the beam pump shaft. The pump shaft is biased towards its fully extended intake stroke position by a torsion spring.

5 Claims, 9 Drawing Figures

FIG. 1
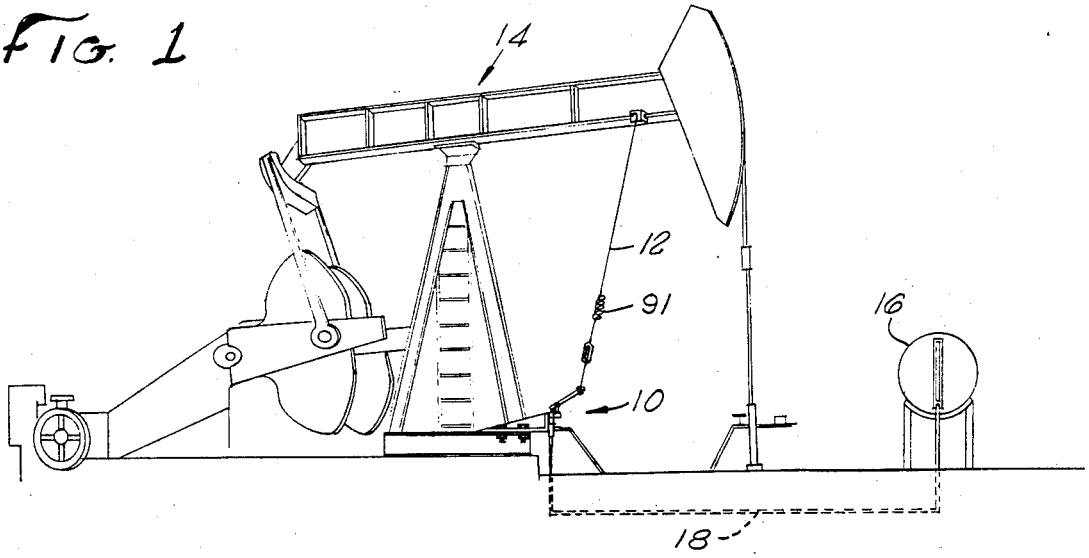
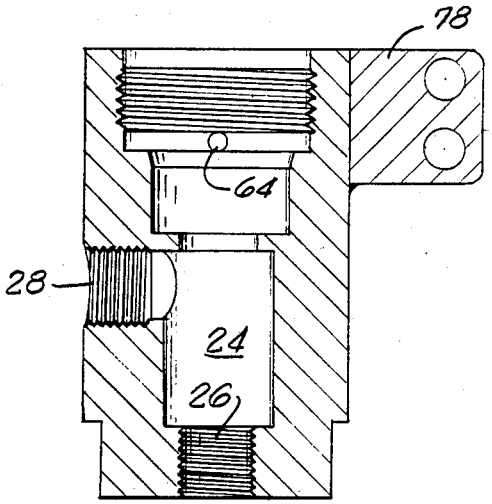
FIG. 7
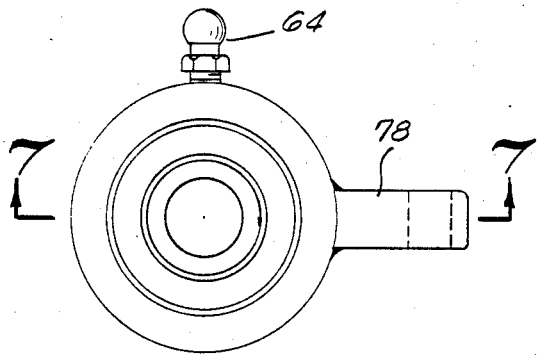
FIG. 6
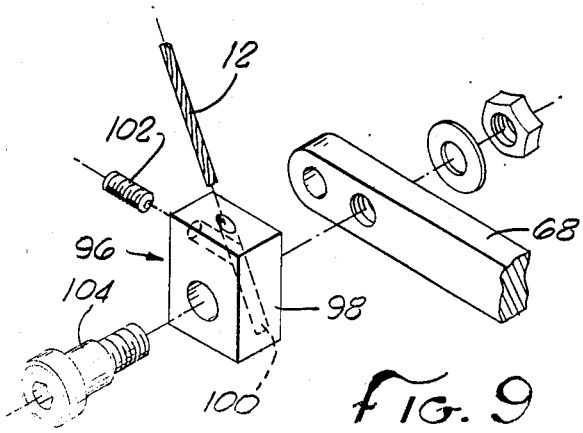
FIG. 9
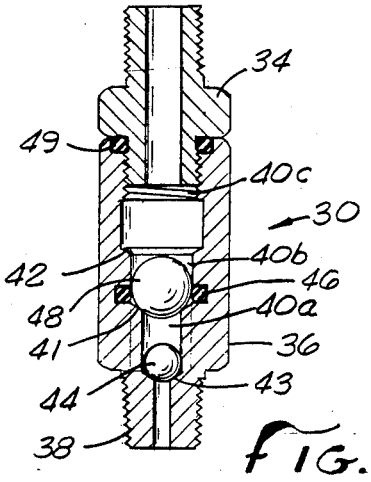
FIG. 8

BEAM PUMP

The field of the invention is chemical injectors, and more particularly, chemical injectors which are tied to a walking beam type pump.

Devices of this type are used to inject quantities of a chemical into a flow line and are commonly used in conjunction with a walking beam oil well pump. Chemical injector pumps of such types may have a pump body with a pumping shaft slidably fitted within. The pumping shaft is typically pivotally connected to a lever bar at one end with the other end of the lever bar connected to the walking beam by a cable, which has a turnbuckle to adjust the tension therein. The center of the lever bar is pivotally supported by a support bar. The other end of the support bar is typically connected to the pump body.

One problem with such a pump is controlling the tendency of the pump shaft to be driven out of alignment with the pump body as the shaft is reciprocated by the lever bar linkage. This problem is exacerbated when the cable from the walking beam is connected to the lever bar in such a way that the cable is non-vertical.

A further problem with such pumps is guiding and lubricating the pump shaft as it moves within the pump body. Such pumps commonly require grease and grease fittings which must be attended to by maintenance personnel as the grease tends to dissipate over time.

A further problem with such pumps is the tendency of the chemicals to be pumped back to the source rather than through the injection line due to leakage through the check valve between the chemical source and the pump.

One guiding means known in the art for guiding the pump shaft as it moves within the pump body is a bronze bushing. It is believed that such bronze bushings tend to wear out relatively quickly thereby requiring frequent maintenance to repair the pump. Also, such a bronze bushing guiding means does not provide a backup seal and may also be a contributing factor in pump seizing.

It is therefore an object of the present invention to provide a beam pump with both a linking means for drivingly connecting a pump shaft to a walking beam and with a sealing and guiding means for a low maintenance lubrication of the pump shaft as it moves within a pump body. The sealing and guiding means also serve to help keep the pump shaft in axial alignment with the pump body as it slides within said body. The sealing and guiding means should further seal the pump body against loss of injection fluid.

It is a further object of the present invention to provide a beam pump with a linking means for drivingly connecting a pump shaft to a walking beam wherein a portion of the linking means is semi-rigidly supported to the pump body to assist in keeping the pump shaft in axial alignment with the pump body.

It is a further object of the present invention to provide a pump body with an O-ring seal disposed around the pump shaft to thereby guide and lubricate the pump shaft as it slides within said pump body and to additionally act as a backup seal.

It is a further object of the present invention to provide a pump shaft surface and a pump body surface disposed around such shaft with respective layers of a solid lubricant material to thereby lubricate such shaft as it moves within said body and accordingly reduce the maintenance requirements for said pump.

It is a further object of the present invention to provide a beam pump double acting check valve which will prevent the chemical from being returned to the source rather than injected through the pump exit. Other and more detailed objects of the invention will become apparent from examination of the description and drawings contained herein, wherein:

FIG. 1 is a plan view of the invention mounted on a walking beam oil well rig;

FIG. 6 is a top view of the unassembled beam pump body;

FIG. 7 is a cross sectional view of the unassembled beam pump body taken substantially along line 7—7 of FIG. 6;

FIG. 8 is a cross sectional view of the double acting check valve; and

FIG. 9 is an exploded view of the means connecting the walking beam cable to the pump lever bar.

Figures 2, 3, 4, 5:
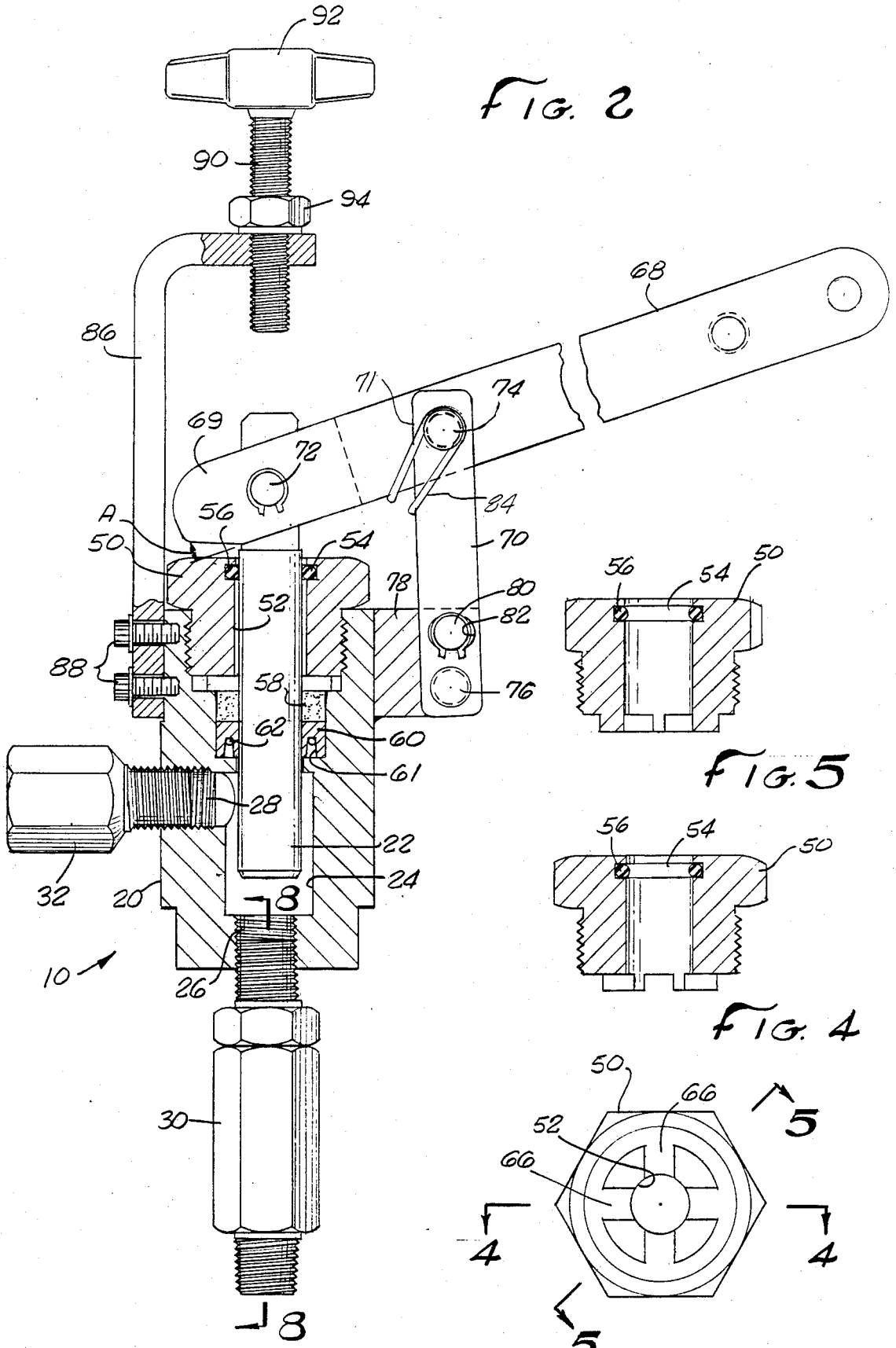
FIG. 2 is a cross sectional view of the assembled beam pump.
FIG. 3 is a bottom view of the beam pump guiding and sealing plug.
FIG. 4 is a cross sectional view of the pump sealing and guiding plug taken substantially along line 4—4 of FIG. 3.
FIG. 5 is a cross sectional view of the pump sealing and guiding plug taken substantially along line 5—5 of FIG. 3.

Referring to FIG. 1, the beam pump 10 is mounted on the oil well rig 14. A cable 12 with a spring 13 synchronizes the operation of the beam pump 10 with the pivoting walking beam of the rig 14. The pump 10 is connected to the chemical source reservoir 16 through a supply line 18 and into the oil pipeline through a separate injection line (not shown).

As shown in FIG. 2 the beam pump 10 has a pump body 20 and a pump shaft 22 slidably fitted therein. As can be seen in FIGS. 2 and 7, the pump body 20 has a centrally located internal injection chamber 24 which provides communication between the chemical source inlet 26 and the chemical injection exit 28. A double acting source check valve 30 is threadedly mounted to the lower portion of the pump body 20. Similarly, an injection check valve 32 is threadedly mounted to the pump body 20 at the chemical injection exit 28.

The double acting source check valve 30 has an upper portion 34 and a lower portion 36. The lower portion 36 is threaded at 38 for attachment to the chemical supply line 18. An internal chamber 40 is formed within the lower portion 36 of the source check valve 30. The internal chamber 40 has three sections **40*a*, 40*b*, 40*c*, each section having a progressively larger diameter thus forming shoulders 41 and 42 at each chamber section longitudinal intersection. A valve seat 43 is formed on the surface where the chemical source line 18 meets the smallest internal chamber bottom section 40*a*. A spherical valve member 44 is fitted in the smallest internal chamber section 40*a* so as to provide a seal in conjunction with the valve seat 43**.

An O-ring 46 is disposed about the second internal chamber **40*b* just upstream of the first internal shoulder 41. A second spherical valve member 48 is fitted within the middle section 40*b* of the internal chamber 40 and on the upstream side of the O-ring 46 so as to provide a seal in conjunction with the O-ring 46 and shoulder 41. Threads are formed about the internal periphery of the largest section 40c of the internal chamber 40. These threads interengage so as to connect the upper portion 34 of the chemical source check valve 30 to the lower portion 36 of the chemical source check valve 30. A second O-ring 49 is fitted about said threaded attachment to prevent leakage between the source check valve lower portion 36 and upper portion 34**.

The pump shaft 22 sealing and guiding means, as shown in FIGS. 2–5, is positioned above said injection chamber 24 in the beam pump body 20. A guide plug 50 is threadedly mounted to the pump body 20. The center portion of guide plug 50 comprises a guide cavity 52. Radially disposed about said guide cavity 52 is a ring groove 54 with an O-ring 56 mounted therein. In the preferred embodiment, said O-ring 56 is made from a solid lubricant material, for example Viton. The pump shaft 22 moves slidably within the guide cavity 52 and slides within and against the O-ring 56 as it reciprocates in its pumping cycle. The O-ring 56 lubricates the pump shaft 22 during such movement. Disposed below the guide plug 50 and radially about the pump shaft 22 is a back up ring 58. Below said backup ring 58 is a sealing ring 60. The sealing ring 60 has a tapered groove 61 formed upward from its bottom in which a spring 62 is mounted to maintain contact between the seal ring 60 and the pump shaft 22.

To further aid in lubricating the pump shaft 22 as it reciprocates within the guide cavity 52, both the surface of the pump shaft 22 and the surface of the guide cavity 52 are coated with a layer of a solid lubricant material such as, for example, Teflon. The surface of the pump shaft 22 may be impregnated down to a depth of one one-thousandth of an inch (0.001") with such solid lubricant material and further coated with a one one-thousandth of an inch (0.001") of such material. It is anticipated that the surface of the guide cavity 52 will be similarly treated.

Additional pump shaft lubricant may be provided through the lubricant fitting 64 as shown in FIGS. 6 and 7. The bottom of the guide plug 50 is provided with perpendicular horizontal lubricant passageways 66. Upon injection of a lubricant, such as grease, through the fitting 64, the grease is able to flow to the surface of the pump shaft 22 through the lubricant passageways 66 in the bottom of the guide plug 50. In addition, the passageways 66 act as a reservoir for the grease to avoid the necessity of frequent maintenance.

The pump is driven by a linking means which includes a lever bar 68 and a pivot support bar 70, both of which are forked at one end 69 and 71, respectively. The forked end 69 of the lever bar 68 is pivotally connected to the pump shaft 22 by a pump shaft pivot pin 72. The center portion of the lever bar 68 rests within the forked end 71 of the pivot support bar 70 and is pivotally connected thereto about a lever bar pivot pin 74. The other end of the pivot support bar 70 is pivotally connected by a pivot support pin 76 to a support mount 78 which is attached to the pump body 20. The support mount 78 has a protruding pivot limiter pin 80 fitting loosely in a pivot limiting hole 82 in the pivot support bar 70.

The other end of the lever bar 68 is attached to the walking beam cable 12 to provide reciprocating motion synchronized with the movement of the walking beam. A torsion spring 84 is connected between the lever bar 68 and the pivot support bar 70 in such a way as to bias the beam pump such that the pump shaft 22 is extended towards its full intake stroke position.

A stroke limiter is used to control the amount of chemical pumped and includes a support bar 86 which is mounted to the pump body 20 by bolt means 88. A pump shaft limiting pin 90 with a handle 92 is threadedly mounted through the stroke limiter support bar 86 such that the limiting pin 90 is axially aligned with the pump shaft 22. A lock nut 94 is provided to maintain the placement of the pump shaft limiting pin 90. The spring in the walking beam cable 12 is used to accommodate the variations in pump shaft 22 stroke.

As shown in FIG. 9, the walking beam cable 12 is connected to the lever bar 68 through a cable clamp 96. The cable clamp 96 has a body portion 98 with an inclined bore 100 into which the cable 12 is inserted. The cable 12 is maintained in the bore 100 by bolt means 102 which act to clamp the cable within the clamp body 98. Additional bolt means 104 are used to attach the cable clamp body 98 to the lever bar 68 of the beam pump 10.

The operation of the beam pump 10 is as follows. As the lever bar 68 reciprocates in response to the movement of the walking beam cable 12 the lever bar 68 pivots about the lever bar pivot pin 74 and thereby reciprocates the pump shaft 22. As the pump shaft 22 reciprocates, it alternately sucks in a charge of injection chemical through the source check valve 30 and injects the chemical through the injection check valve 32. It is the natural tendency with this type of pump linkage for the pump shaft 22 to be pulled or pushed out of axial alignment with the pump body 20. This is especially true if the walking beam cable 12 is not connected vertically to the end of the lever bar 68. The pivot limiter pin 80 is designed to strike the edge of the pivot limiting hole 82 to prevent excessive non-aligned movement by the pump shaft 22 relative to the pump body 20. As mentioned previously, the O-ring 56 and the guide plug 50 also assist in maintaining pump shaft 22 axial alignment.

The axial motion of the pump shaft 22 may be limited by the pump shaft limiting pin 90. By decreasing the axial movement of the pump shaft 22, the rate of chemical injection may be controlled. To prevent damage to the pump 10 when the lever bar 68 is being reciprocated in too wide of an arc, the pump-adjacent sides of the forked end 69 of the lever bar 68 is angled. This angle, marked A in FIG. 2, is 20° in the preferred embodiment. If the lever bar 68 is lifted excessively, this angled portion will tend to be flattened against the upper surface of the guide plug 50.

In addition, to aid the lever bar pivot pin 74, the inner portion of the forked end 71 of the pivot support bar 70 has downward sloping angles, marked B in FIG. 2, on both sides. The downward sloping angles provide additional support for the lever bar pivot pin 74 as well as limit the movement of the lever bar 68. In the preferred embodiment, these angles B are 22°.

Having fully described the invention, it is to be understood that the description contained herein is merely to be used for illustration and no limitations beyond those set forth in the appended claims should be construed herefrom.

I claim:

1. In a walking beam pump having a pump body with a guide cavity which a pump shaft moves slidab1y within for the pumping of a chemical, the pump shaft is pivotally connected to a lever bar with the other end of the lever bar connected to a walking beam cable and the center portion of the lever bar pivotally connected to a pivot support bar with the other end of the pivot support bar pivotally connected to the pump body, the improvement comprising, pivot limiting holes in the pivot support bar, said holes loosely fitting around a pivot limiter connected to the beam pump body whereby the sides of said pivot limiting holes are enabled to come to rest against said pivot limiter to prevent non-alignment between the pump shaft and the pump body due to excessive longitudinal horizontal movement of the lever bar by reason of excessive pivoting of the support bar that would otherwise occur.

2. A beam pump as set forth in claim 1 wherein means are provided for biasing said pump shaft to its fully extended intake stroke position including a torsion spring connected between the pump lever bar and the pivot support bar.

3. The beam pump of claim 1 wherein said lever bar includes an end portion dimensioned and shaped for engaging said pump body upon pivoting of said lever bar in the direction for urging said pump shaft into said pump body for also limiting the movement of said lever bar and pump shaft.

4. The walking beam pump of claim 1 wherein a stroke limiter support bar is mounted on said pump body and extends to a position aligned with and spaced above said pump shaft, and an adjuster pin is mounted on said stroke limiter support bar in alignment with said pump shaft and has means for adjusting said pin toward and away from said pump shaft for engaging and limiting the movement of said pump shaft for adjusting the pumping stroke.

5. The walking beam pump of claim 4 wherein said lever bar includes an end portion dimensioned and shaped for engaging said pump body upon pivoting of said lever bar in the direction for urging said pump shaft into said pump body for also causing limiting of the movement of said lever bar and pump shaft.

* * * * *